US009041274B2

(12) United States Patent
Kowalski et al.

(10) Patent No.: US 9,041,274 B2
(45) Date of Patent: May 26, 2015

(54) SPARK PLUG HAVING FIRING PAD

(71) Applicant: Federal-Mogul Ignition Company, Southfield, MI (US)

(72) Inventors: Kevin J. Kowalski, Perrysbury, OH (US); Frederick J. Quitmeyer, Rochester Hills, MI (US); Nathan A. Thomson, Southgate, MI (US); Curtis W. Verhoff, Canton, MI (US); Richard L. Keller, Whitehouse, OH (US)

(73) Assignee: Federal-Mogul Ignition Company, Southfield, MI (US)

( * ) Notice: Subject to any disclaimer, the term of this patent is extended or adjusted under 35 U.S.C. 154(b) by 0 days.

(21) Appl. No.: 14/166,145

(22) Filed: Jan. 28, 2014

(65) Prior Publication Data

US 2014/0210334 A1 Jul. 31, 2014

Related U.S. Application Data

(60) Provisional application No. 61/759,088, filed on Jan. 31, 2013.

(51) Int. Cl.
*H01T 13/20* (2006.01)
*H01T 13/32* (2006.01)
*H01T 21/02* (2006.01)

(52) U.S. Cl.
CPC ..... *H01T 13/32* (2013.01); *H01T 21/02* (2013.01)

(58) Field of Classification Search
CPC ..... H01T 13/00; H01T 13/39; H01T 13/32; H01T 13/20; H01T 13/36; H01T 13/38; H01T 13/50; H01T 13/467; H01T 13/18; H01T 13/41; H01T 13/54; H01T 13/02; H01T 13/14; H01T 13/16; H01T 13/34; H01T 13/52; H01T 21/02; H01T 21/06; F02P 13/00
USPC ..... 313/118–145; 123/169 R, 169 EL, 32, 123/41, 310
See application file for complete search history.

(56) References Cited

U.S. PATENT DOCUMENTS

| | | | | |
|---|---|---|---|---|
| 4,109,633 | A * | 8/1978 | Mitsudo et al. | 123/169 EL |
| 4,581,558 | A * | 4/1986 | Takamura et al. | 313/141 |
| 5,797,383 | A | 8/1998 | Matsubara et al. | |
| 5,990,602 | A | 11/1999 | Katoh et al. | |
| 6,337,533 | B1 | 1/2002 | Hanashi et al. | |
| 6,523,515 | B2 | 2/2003 | Kanao | |
| 6,642,638 | B2 | 11/2003 | Ishiguro | |
| 6,676,468 | B2 | 1/2004 | Ishiguro et al. | |
| 6,707,237 | B2 | 3/2004 | Teramura et al. | |
| 6,853,116 | B2 | 2/2005 | Hori et al. | |
| 6,864,623 | B2 | 3/2005 | Ishikawa | |
| 6,923,699 | B2 | 8/2005 | Matsubara et al. | |
| 7,306,502 | B2 * | 12/2007 | Hori | 445/7 |
| 7,449,822 | B2 * | 11/2008 | Yorita et al. | 313/141 |
| 7,557,495 | B2 | 7/2009 | Tinwell | |

(Continued)

*Primary Examiner* — Anne Hines
*Assistant Examiner* — Jose M Diaz
(74) *Attorney, Agent, or Firm* — Reising Ethington P.C.

(57) ABSTRACT

A spark plug has a shell, an insulator, a center electrode, a ground electrode, and a firing pad. The firing pad is made of a precious metal material and is attached to the ground electrode. The firing pad has a side surface at a peripheral edge that can be flush or nearly flush with a free end surface of the ground electrode. This construction can help improve ignitability and flame kernel growth of the spark plug during a sparking event, and can provide better thermal management at the attached ground electrode and firing pad.

17 Claims, 4 Drawing Sheets

(56) References Cited

U.S. PATENT DOCUMENTS

| | | | | |
|---|---|---|---|---|
| 7,615,915 | B2 | 11/2009 | Ito et al. | |
| 7,804,232 | B2 * | 9/2010 | Kumagai et al. | 313/141 |
| 7,808,165 | B2 * | 10/2010 | Kowalski | 313/141 |
| 7,973,459 | B2 | 7/2011 | Tinwell | |
| 8,013,503 | B2 * | 9/2011 | Kameda et al. | 313/141 |
| 8,106,572 | B2 | 1/2012 | Tanaka et al. | |
| 8,106,573 | B2 | 1/2012 | Boehler et al. | |
| 8,115,372 | B2 | 2/2012 | Kameda | |
| 8,203,258 | B2 | 6/2012 | Kameda et al. | |
| 8,212,462 | B2 | 7/2012 | Kato | |
| 8,212,463 | B2 | 7/2012 | Sakayanagi et al. | |
| 8,253,313 | B2 * | 8/2012 | Inoue et al. | 313/141 |
| 8,288,930 | B2 * | 10/2012 | Quitmeyer et al. | 313/141 |
| 8,324,791 | B2 * | 12/2012 | Kameda et al. | 313/141 |
| 8,643,262 | B2 * | 2/2014 | Quitmeyer et al. | 313/141 |
| 2002/0038992 | A1 * | 4/2002 | Morita et al. | 313/141 |
| 2002/0105254 | A1 * | 8/2002 | Hori et al. | 313/141 |
| 2003/0071552 | A1 * | 4/2003 | Teramura et al. | 313/143 |
| 2004/0012318 | A1 * | 1/2004 | Ishikawa | 313/141 |
| 2004/0092193 | A1 * | 5/2004 | Musasa et al. | 445/7 |
| 2004/0239223 | A1 * | 12/2004 | Watanabe | 313/141 |
| 2009/0140624 | A1 * | 6/2009 | Kameda et al. | 313/141 |
| 2009/0284118 | A1 * | 11/2009 | Tinwell | 313/141 |
| 2010/0084391 | A1 | 4/2010 | Nakayama et al. | |
| 2010/0109502 | A1 | 5/2010 | Nakayama et al. | |
| 2011/0133625 | A1 | 6/2011 | Sakayanagi | |
| 2011/0175514 | A1 * | 7/2011 | Kameda | 313/141 |
| 2011/0198981 | A1 | 8/2011 | Kishimoto et al. | |
| 2012/0025690 | A1 | 2/2012 | Kohl | |
| 2012/0025691 | A1 | 2/2012 | Sakayanagi et al. | |
| 2012/0086326 | A1 | 4/2012 | Niessner et al. | |
| 2012/0190266 | A1 * | 7/2012 | Hanashi et al. | 445/7 |
| 2013/0069516 | A1 * | 3/2013 | Sumoyama et al. | 313/141 |

* cited by examiner

SPARK PLUG HAVING FIRING PAD

REFERENCE TO RELATED APPLICATIONS

This application claims the benefit of U.S. Provisional Ser. No. 61/759,088 filed on Jan. 31, 2013, the entire contents of which are incorporated herein.

TECHNICAL FIELD

This disclosure generally relates to spark plugs and other ignition devices for internal combustion engines and, in particular, to a firing pad that is attached to an electrode.

BACKGROUND

Spark plugs can be used to initiate combustion in internal combustion engines. Spark plugs typically ignite a gas, such as an air/fuel mixture, in an engine cylinder or combustion chamber by producing a spark across a spark gap defined between two or more electrodes. Ignition of the gas by the spark causes a combustion reaction in the engine cylinder that causes the power stroke of the engine. The high temperatures, high electrical voltages, rapid repetition of combustion reactions, and the presence of corrosive materials in the combustion gases can create a harsh environment in which the spark plug functions. This harsh environment can contribute to erosion and corrosion of the electrodes and can negatively affect the performance of the spark plug over time, potentially leading to a misfire or some other undesirable condition.

To reduce erosion and corrosion of the spark plug electrodes, various types of noble metals and their alloys—such as those made from platinum and iridium—have been used. These materials, however, can be costly. Thus, spark plug manufacturers sometimes attempt to minimize the amount of precious metals used with an electrode by using such materials only at a firing tip of the electrodes where a spark jumps across a spark gap.

SUMMARY

According to one embodiment, a spark plug includes a shell, an insulator, a center electrode, a ground electrode, and a firing pad. The shell has an axial bore, and the insulator has an axial bore. The insulator is disposed partially or more within the shell's axial bore. The center electrode is disposed partially or more within the insulator's axial bore. The ground electrode is attached to the shell and has a free end surface. The firing pad is attached to the ground electrode and has a side surface. The free end surface of the ground electrode and the side surface of the firing pad are flush or nearly flush with respect to each other.

According to another embodiment, a method of preparing a ground electrode and firing pad assembly includes several steps. One step involves trimming a free end portion of the ground electrode, thus leaving a trimmed free end surface. Another step involves locating the firing pad at the free end portion. The firing pad has a side surface located at or near the trimmed free end surface of the ground electrode. Yet another step involves emitting a laser beam to the firing pad and inboard of the side surface at an extent of the side surface that is located at or near the trimmed free end surface.

According to yet another embodiment, a method of preparing a ground electrode and firing pad assembly includes a couple of steps. One step involves laser welding the firing pad to a free end portion of the ground electrode to produce a weldment. The firing pad has a side surface. Another step involves trimming the free end portion of the ground electrode along a trim line. The trim line is situated at or near the side surface of the firing pad. The weldment is positioned inboard of the side surface at least where the trim line is situated at or near the side surface.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

The firing pads and electrodes described herein can be used in spark plugs and other ignition devices including industrial plugs, aviation igniters, or any other device that is used to ignite an air/fuel mixture in an engine. This includes spark plugs used in automotive internal combustion engines, and particularly in engines equipped to provide gasoline direct injection (GDI), engines operating under lean burning strategies, engines operating under fuel efficient strategies, engines operating under reduced emission strategies, or a combination of these. The various firing pads and electrodes may provide improved ignitability, effective pad retention, increased pad exposure to air/fuel mixture, and cost effective solutions for the use of noble metal, to cite some possible improvements. As used herein, the terms axial, radial, and circumferential describe directions with respect to the generally cylindrical shape of the spark plug of FIG. 1 and with reference to a center axis A of the spark plug, unless otherwise specified.

Figure 1:
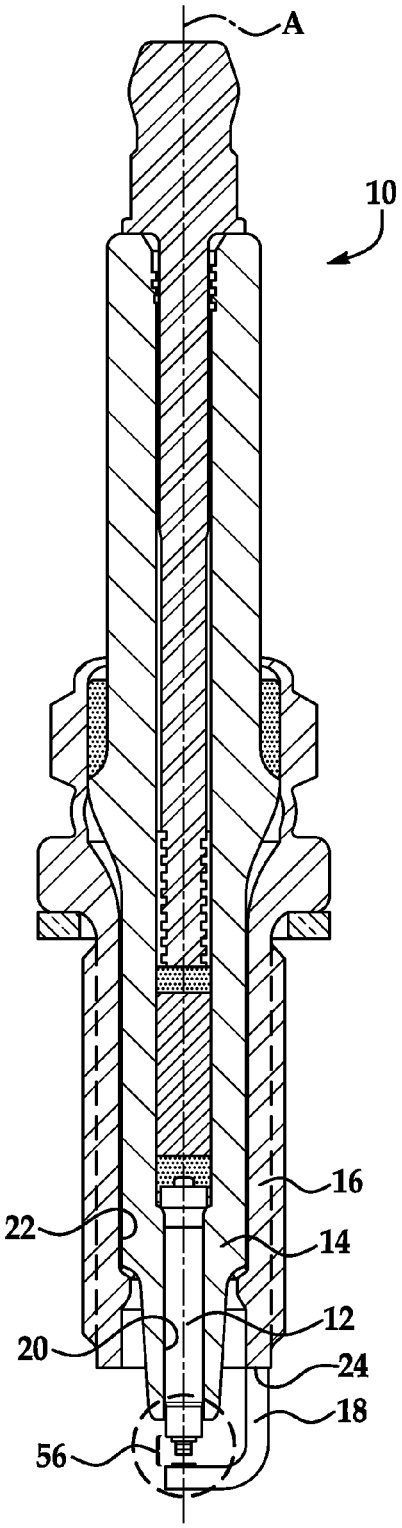
FIG. 1 is a sectional view of an exemplary spark plug.

Referring to FIG. 1, a spark plug 10 includes a center electrode (CE) base or body 12, an insulator 14, a metallic shell 16, and a ground electrode (GE) base or body 18. Other components can include a terminal stud, an internal resistor, various gaskets, and internal seals, all of which are known to those skilled in the art. The CE body 12 is generally disposed within an axial bore 20 of the insulator 14, and has an end portion exposed outside of the insulator at a firing end of the spark plug 10. In one example, the CE body 12 is made of a nickel (Ni) alloy material that serves as an external or cladding portion of the body, and includes a copper (Cu) or Cu alloy material that serves as an internal core of the body; other materials and configurations are possible including a non-cored body of a single material. The insulator 14 is generally disposed within an axial bore 22 of the metallic shell 16, and has an end nose portion exposed outside of the shell at the firing end of the spark plug 10. The insulator 14 is made of a material, such as a ceramic material, that electrically insulates the CE body 12 from the metallic shell 16. The metallic shell 16 provides an outer structure of the spark plug 10, and has threads for installation in an engine.

Figure 2:
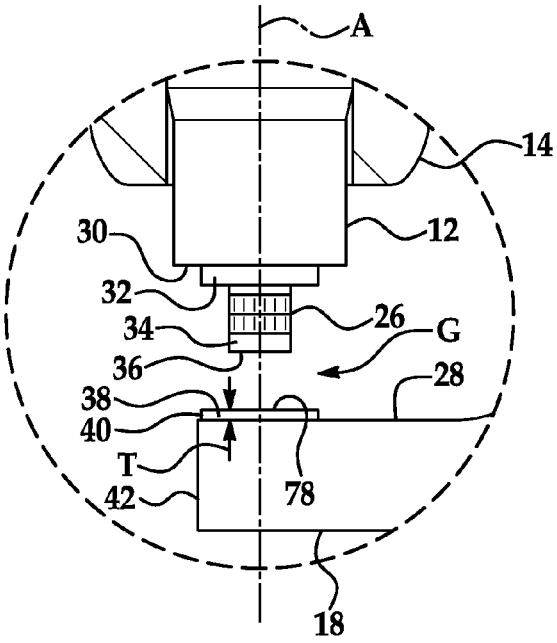
FIG. 2 is an enlarged view of a firing end of the spark plug of FIG. 1, where the firing end includes an exemplary firing pad.

Referring now to FIGS. 1 and 2, the GE body 18 is attached to a free end of the metallic shell 16 at an attachment interface 24 and, as a finished product, may have a generally L-shape. At an end portion nearest a spark gap G, the GE body 18 is axially spaced from the CE body 12 and from a CE firing tip 26 (if one is provided). Like the CE body, the GE body 18 may be made of a Ni alloy material that serves as an external or cladding portion of the body, and can include a Cu or Cu alloy material that serves as an internal core of the body; other examples are possible including non-cored bodies of a single material. Some non-limiting examples of Ni alloy materials that may be used with the CE body 12, GE body 18, or both, include an alloy composed of one or more of Ni, chromium (Cr), iron (Fe), manganese (Mn), silicon (Si), or another element; and more specific examples include materials commonly known as Inconel® 600 or 601. In cross-sectional profile, the GE body 18 can have a generally rectangular shape or some other suitable profile. The GE body 18 has an axially-facing working surface 28 that generally confronts and opposes the CE body 12 or the CE firing tip 26 across the spark gap G.

As mentioned, in the embodiment shown in the figures, the spark plug 10 includes the optional CE firing tip 26 that is attached to an axially-facing working surface 30 of the CE body 12 and exchanges sparks across the spark gap G. Referring particularly to FIG. 2, the CE firing tip 26 shown here has a two-piece and generally rivet-like construction and includes a first piece 32 (rivet head) welded to a second piece 34 (rivet stem). The first piece 32 may be directly attached to the CE body 12, and the second piece 34 may be directly attached to the first piece so that an axially-facing sparking surface 36 is provided for exchanging sparks across the spark gap G. The first piece 32 can be made of a Ni-alloy material, and the second piece 34 can be made of a noble metal-alloy material such as one including iridium (Ir), platinum (Pt), or ruthenium (Ru), Other materials for the first and second pieces 32, 34 are possible. In other embodiments not shown in the drawings, for example, a discrete CE firing tip is omitted, in which case sparks are exchanged from the CE body 12 itself. The optional firing tip 26 could have a one-piece or single-material construction and it could have different shapes including non-rivet-like shapes such as cylinders, bars, columns, wires, balls, mounds, cones, flat pads, rings, or sleeves, to cite several possibilities. The present spark plug is not limited to any particular firing end arrangement, as the firing pads described herein could be used with any number of firing end arrangements, including those with or without CE firing tips.

The spark plug 10 further includes a firing pad 38 made of a precious metal material and attached via welding to the working surface 28 of the GE body 18 for exchanging sparks across the spark gap G. Compared to previously-known firing tips, a side surface or periphery 40 of the firing pad 38 is closer in proximity to, and in some embodiments precisely at, a free end surface 42 of the GE body 18. This provides an increased exposure and availability of the firing pad 38 to air/fuel mixture during a sparking event, with the shifted position of the firing pad and thereby greater absence of the GE body 18 between the free end surface 42 and the side surface 40. Ignitability and flame kernel growth are therefore enhanced because the spark exchanged with or by the firing pad 38 is more readily accessible to the injected air/fuel mixture, and there is minimized obstruction to flame kernel growth from the GE body 18 at the free end surface 42, among other possible improvements and causes. Furthermore, the greater absence of the GE body 18 between the free end surface 42 and the side surface 40 minimizes thermal mass and hence reduces the capacity of stored heat thereat, which could potentially degrade retention between the GE body and firing pad 38 over time. In other words, it has been found that in some cases more heat will remain with the GE body 18 at the firing pad 38 if the GE body spans beyond the firing pad's side surface 40, and the heat could weaken the attachment between the GE body and firing pad. The ability to position the firing pad 38 closer to the free end surface 42 can be contributed to the geometry of the firing pad and the location of a solidified weldment 44 relative to the side surface 40, among other possible factors.

In one previously-known precious metal firing tip, a so-called seam weld is performed in which a laser beam is emitted directly at and directly strikes a periphery of the firing tip at an interfacial boundary between the firing tip and the ground electrode body. The resulting solidified weld pool at the seam spans outwardly of the firing tip's periphery and bleeds over and onto the ground electrode body for a not insubstantial distance away from the firing tip. While seam welds are suitable in some spark plugs, this means that the firing tip should be positioned a sufficient distance away from the free end surface of the ground electrode body so that the seam weld can be performed and in order to ensure retention capabilities. This also means that a subsequent trimming operation of the free end portion of the ground electrode body cannot be performed through the solidified weld pool without jeopardizing the retention effect provided by the seam weld and increasing wear, tear, and dulling on the trimming equipment caused by cutting through the hardened weld pool. The seam weld thereby precludes the firing tip from being positioned as close to the free end surface of the ground electrode body as desired in some circumstances. As will be described below, the firing pad 38, on the other hand, can be positioned adjacent and even precisely at the free end surface 42 without the restrictions associated with seam welds. A trimming operation can also be performed without compromising the retention effect provided by the weldment 44.

Figure 3:
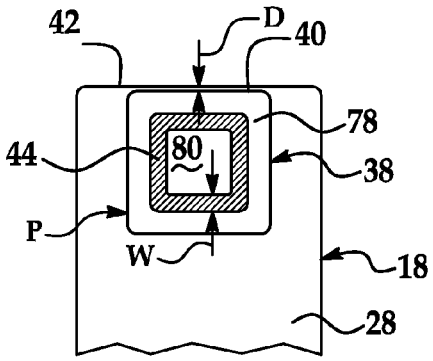
FIG. 3 is an enlarged view of an exemplary ground electrode with the firing pad of FIG. 2.

Referring still to FIG. 3, a distance D dimension taken between the side surface 40 of the firing pad 38 and the free end surface 42 of the GE body 18 can be less than that of the previously-known firing tips with seam welds, and can help ensure enhanced ignitability and flame kernel growth during a sparking event. The distance D, as used herein, is the shortest geometrically straight-line distance between the side surface 40 and the free end surface 42; in the embodiment of FIG. 3, the distance D happens to be a lateral distance measured orthogonal to the parallel surfaces 40, 42 and in a plane parallel to the working surface 28, but in other embodiments the distance D need not necessarily be orthogonal to surfaces of the firing pad and GE body and can reside in different planes; indeed, as described below in different embodiments, the distance D could be zero. The exact value of the distance D can vary in different embodiments, but establishes a flush or nearly flush relationship between the free end surface 42 and the side surface 40. In some non-limiting examples, the distance D can be less than or equal to approximately 0.7 millimeters (mm), can be less than or equal to approximately 0.25 mm, can be less than or equal to approximately 0.15 mm, or can be greater than 0 but still less than or equal to approximately 0.7 mm or 0.25 mm. It has been found that keeping the value of the distance D within these amounts provides greater exposure of the firing pad 38 and hence improved ignitability and flame kernel growth, and better thermal management of the GE body 18. For instance, when the value of the distance D falls outside of these amounts, the spark exchanged with or by the firing pad may not be as readily accessible to the air/fuel mixture as desired, and ignitability and flame kernel growth may in-turn not be enhanced as desired.

Similarly, enhanced ignitability and flame kernel growth and better thermal management are provided when certain relationships are satisfied that relate to the distance D. In some non-limiting examples, the distance D taken between the side surface 40 and the free end surface 42 can range between approximately 0% to 500% of a thickness dimension T (FIG. 2) of the firing pad 38. Though the thickness dimension T is shown in FIG. 2 after the firing pad 38 is attached to the GE body 18, the thickness dimension T referred to herein is actually a measurement taken before the pad is attached to the GE body. And in some non-limiting examples, the thickness T dimension of the firing pad 38 ranges between approximately 0.05 mm and 0.2 mm; ranges between approximately 0.1 mm and 0.16 mm; or is approximately 0.13 mm; other thickness ranges and values are possible in other examples. Further, the distance D can range between approximately 0% to 200% of the thickness of the firing pad 38, can range between approximately 100% to 500% of the thickness of the pad, or can range between approximately 100% to 200% of the thickness of the pad. Still, other relationships can involve a width dimension W (FIG. 3) of the weldment 44. In a non-limiting example, the distance D can range between approximately 0% to 150% of the width W, can range between approximately 50% to 150% of the width W, can range between approximately 50% to 100% of the width W, or can range between approximately 100% to 150% of the width W. And in some non-limiting examples, the width W of the weldment 44 can range between approximately 0.14 mm and 0.30 mm. As used herein, values within the ranges include the lower and upper limit values of the ranges so that, for example, the range of 0% to 500% includes the values 0% and 500%.

Figure 4:
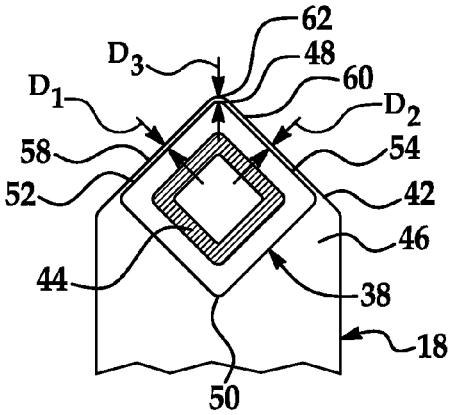
FIGS. 4-7 are enlarged views of other exemplary ground electrodes and firing pads.

Referring now to FIG. 4, in another embodiment the firing pad 38 can have a diamond orientation, and a free end portion 46 of the GE body 18 can be trimmed. In the diamond orientation, and from FIG. 3 to FIG. 4, the firing pad 38 is turned about its center so that a first corner 48 and a second corner 50 are in alignment with a lengthwise extent of the GE body 18. The example firing pad 38 has a generally square shape and hence, in the diamond orientation, its greatest dimension across its sparking surface between the corners 48, 50 is in-line with a direction of bending of the GE body 18 to the L-shape about the lengthwise extent; this facilitates spark-gapping alignment between the firing pad 38 and the CE firing tip 26 (if one is provided), as the dimension between the corners 48, 50 can often be greater than the diameter of the CE firing tip so that the pad and tip can be more readily overlapped during bending. Further, in the diamond orientation, a first side surface 52 and a second side surface 54 of the firing pad 38 are generally directed toward the free end surface 42 of the GE body 18 and toward an open side 56 (see FIG. 1) of the spark plug firing end.

The free end portion 46 of the GE body 18 can be trimmed or tapered in the radial direction via a cutting or severing process. The trimming can be carried out via a cutting blade, a laser, or some other way. In other embodiments, the firing pad 38 can have a diamond orientation without the radial trimming and instead with a free end portion like that of FIG. 3. The trimming provides the free end portion 46 of FIG. 4 with a first free end surface 58 and a second free end surface 60 that intersect at a free end corner 62. The first and second free end surfaces 58, 60 can be cut at approximately forty-five degree angles relative to the lengthwise extent of the GE body 18 and thereby can define an approximate ninety degree angle relative to each other at the free end corner 62. The free end corner 62 can remain pointed after the cutting process, or can be rounded off some.

Like the embodiment of FIG. 3, the side surfaces 52, 54 of the firing pad 38 of FIG. 4 are closer in proximity to—and in some cases precisely at—the respective free end surfaces 58, 60 compared to previously-known firing tips with seam welds. The corners 48, 62 can be similarly closer in proximity and in some cases precisely at each other. This too provides the enhanced ignitability and flame kernel growth and better thermal management described above. In this embodiment, a first distance $D_1$ dimension is taken between the parallel first side surface 52 and the first free end surface 58, a second distance $D_2$ dimension is taken between the parallel second side surface 54 and the second free end surface 60, and a third distance $D_3$ dimension is taken between the first corner 48 and the free end corner 62. The distances $D_1$, $D_2$, and $D_3$ of FIG. 4 are similar to the distance D of FIG. 3, and the description of the distance D's measurement, values, and relationships above apply here for the distances $D_1$, $D_2$, and $D_3$. Whatever their values or relationships, the distances $D_1$, $D_2$, and $D_3$ need not necessarily be equal to one another so that, for example, the first distance $D_1$ could be less than or equal to approximately 0.7 mm, while the second distance $D_2$ could range between approximately 100% to 200% of the thickness of the firing pad 38. Furthermore, because the diamond orientation provides two side surfaces (first and second 52, 54) directed toward the open side 56 as opposed to a single side surface as in the embodiment of FIG. 3, the diamond orientation may provide an even more enhanced ignitability and flame kernel growth than that provided by the embodiment of FIG. 3, though this is not necessarily always the case. It is currently believed that one reason for this even greater enhancement is because sparks are sometimes more readily exchanged with or by surface edges and intersections, and the surface edges and intersections of FIG. 4 are more readily accessible to the injected air/fuel mixture via the distances $D_1$, $D_2$, and $D_3$.

Figure 5:
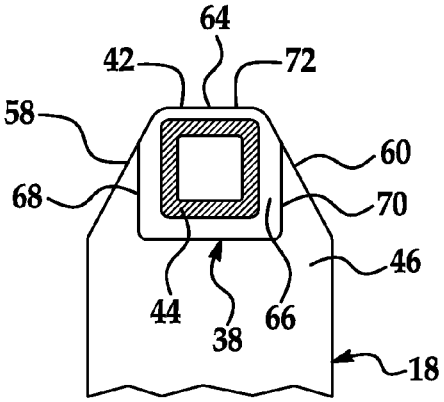

Referring now to FIG. 5, in another embodiment the trimming of the free end portion 46 of the GE body 18 can also be performed through the firing pad 38 itself, as opposed to the embodiment of FIG. 4 in which the firing pad is untrimmed after its attachment and in its state of use. The trimming here, or pre-trim, provides the free end portion 46 with the first free end surface 58, the second free end surface 60, and a third free end surface 64. As is described in greater detail below, the weldment 44 can be located inboard of the pad's side surfaces and thereby producing an outboard and substantially unattached portion 66. In this embodiment, the trimming process is performed through a section of the unattached portion 66. The cut or sever providing the first free end surface 58 goes physically through the unattached portion 66 adjacent a first side surface 68, the cut or sever providing the second free end surface 60 goes physically through the unattached portion adjacent a second side surface 70, and the cut or sever providing the third free end surface 64 goes physically through the unattached portion adjacent a third side surface and produces a newly formed third side surface, or trimmed side surface, 72 of the firing pad 38. The surfaces 64, 72 are parallel and flush in this embodiment, while the surfaces 58, 68 and 60, 70 are non-parallel.

Where the trimming goes through the unattached portion 66, the distance D dimension as previously presented has a value of zero. In other words, the respective side surfaces of the firing pad 38 and free end surfaces of the GE body 18 are flush and aligned with each other and, in a sense, can be continuations of the same surface. For example, a part of the first side surface 68 is newly-formed via the trimming and is precisely at the first free end surface 58, and therefore the distance D dimension is zero; likewise, a part of the second side surface 70 is newly-formed and is precisely at the second free end surface 60, giving the distance D dimension also a zero value; and the entire third side surface 72 is precisely at and aligned with the third free end surface 64, giving the distance D dimension a zero value. In the embodiment of FIG. 5, the trimming is not performed through the weldment 44, though it could be. As before, the zero values of the distances D in this embodiment provide the enhanced ignitability and flame kernel growth and better thermal management described above.

The trimming process could also be performed through the unattached portions in the embodiments of FIGS. 3 and 4, and would then give the distances D, $D_1$, $D_2$, and $D_3$ a zero value.

Figure 6:
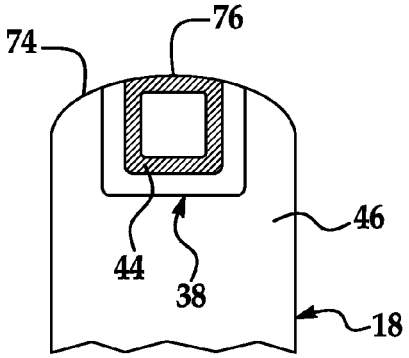

Referring now to FIG. 6, in yet another embodiment the trimming of the free end portion 46 of the GE body 18 can be performed through a section of the weldment 44. The trimming here is arcuate and provides a rounded off free end surface 74 of the free end portion 46. The cut or sever goes physically through an outwardly-most section of the weldment 44 and produces a side surface 76 of the firing pad 38. In this embodiment, while the trimming is indeed made through the weldment 44, it does not substantially affect the retention capabilities provided by the weldment between the firing pad 38 and GE body 18. The distance D dimension here has, similar to earlier embodiments, a value of zero, and therefore provides enhanced ignitability and flame kernel growth and better thermal management. It is possible for the trimming to occur just beyond the weldment 44, as in the case of FIG. 5, so that the weldment remains completely intact.

Figure 7:
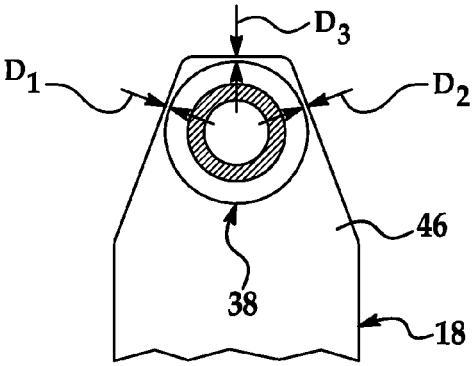

Referring now to FIG. 7, in yet another embodiment, the firing pad 38 has a generally circular shape, and the free end portion 46 is trimmed at its sides but not at its top. As in earlier embodiments, the description of the distance D's measurement, values, and relationships above apply here for the distances $D_1$, $D_2$, and $D_3$, and the distances $D_1$, $D_2$, and $D_3$ need not necessarily be equal to one another. And, as in earlier embodiments, the cut or sever could go physically through the firing pad 38.

Referring back to FIGS. 2 and 3, the firing pad 38 is provided as a thin pad in the sense that its greatest width dimension across a sparking surface 78 is usually several times or more larger than its greatest axial thickness dimension T through the firing pad. The thin pad is different than many previously-known firing tip configurations with so-called fine wire constructions in which the greatest width dimension across the sparking surface of the wire (i.e., the diameter) is less than the thickness dimension of the wire (i.e., the axial height). Its thinness gives the firing pad 38 a relatively large sparking surface 78 with respect to the total amount of precious metal used, resulting in cost savings, particularly when compared to previously-known fine wire tips. The sparking surface 78 directly confronts and opposes a complementary sparking surface on the CE (with or without discrete firing tip 26), between which sparks are exchanged across the spark gap G during operation of the spark plug 10.

As shown in FIG. 3, the weldment 44 may be a single continuous weld or molten bond that is located entirely inboard or radially inward of a peripheral edge P and the side surface 40, and that generally follows the shape of the peripheral edge P, in this case a square. In other embodiments not shown in the figures, the weldment 44 need not be located wholly inboard of the peripheral edge P and could instead be made up of discrete individual weldments (i.e., non-continuous welds); for example, the weldment could begin and/or end outboard of the peripheral edge P on the GE body 18 (i.e., weld starting and stopping points on the GE body itself), and could be discrete lines that span entirely across the firing pad 38 and criss-cross one another. In the embodiment of FIG. 3, by its inboard location and continuity, a first or inner unfused portion 80 is defined within the radially-inward confines of the weldment 44, and the unattached portion 66 is defined radially-outward of the weldment and spans to the peripheral edge P. Furthermore, the weldment 44 provides an improved retention of the firing pad 38 and an improved consistency among welds of manufactured spark plugs, compared to the previously-known seam welds.

The firing pad 38 is preferably made from a noble metal material and can be formed into its thin shape before or after it is welded to the GE body 18. The firing pad 38 can be made from a pure precious metal or a precious metal alloy, such as those containing platinum (Pt), iridium (Ir), ruthenium (Ru), or a combination thereof. In some non-limiting examples, the firing pad 38 is made from a Pt alloy containing between approximately 10 wt % and 30 wt % Ni and/or Ir and the balance being Pt, or one containing between approximately 1 wt % and 10 wt % tungsten (W) and the balance being Pt; in either of the preceding Pt-alloy examples, other materials like Ir, Ru, rhodium (Rh), rhenium (Re), or a combination thereof could also be included. Other materials are possible for the firing pad 38, including pure Pt, pure Ir, pure Ru, to name a few. Before being welded to the GE body 18, the firing pad 38 can be produced by way of various processes and steps including heating, melting, and metalworking. In one example, the firing pad 38 is stamped, cut, or otherwise formed from a thin sheet or tape of precious metal material; in another example, the firing pad is cut or sliced from a wire of precious metal material with a diamond saw or other severing tool, which can then be further flattened or metalworked to refine its shape.

The firing pad 38 can be attached to the GE body 18 by a number of welding types, techniques, processes, steps, etc. The exact attachment method employed can depend upon, among other considerations, the materials used for the firing pad 38 and for the GE body 18, and the exact shape and size of the firing pad. In one example, a fiber laser welding type and technique can be performed, as well as other laser welding types and techniques that use Nd:YAG, $CO_2$, diode, disk, and hybrid laser equipment, with or without shielding gas (e.g., argon) in order to protect the molten weld pool. In the fiber laser example, the fiber laser emits a relatively concentrated and high energy density beam that can create the weldment 44, also called a keyhole weldment; other laser beams can also produce a suitably concentrated and high energy density beam and keyhole weld. The beam can be a non-pulsed or continuous wave beam, a pulsed beam, or some other type. In the embodiments of the figures, the beam's point of entry is at the sparking surface 78, and the thermal energy emitted penetrates entirely through the thickness T of the firing pad 38 and penetrates into the GE body 18 vertically below the surface-to-surface interface. The beam can be aimed at a generally orthogonal angle relative to the sparking surface 78, or can be aimed at another non-orthogonal angle. In a specific example, the laser weld beam has a repetition rate of 500 Hz, a pulse period of 2 ms, a pulse width of 0.7 ms, a duty cycle of 35%, a welding speed of 25 mm/s, a pulse-to-pulse distance of 0.05 mm, a gas flow rate of 30 SCFH, and a laser power of 70-100 W; of course, in other examples other parameters are possible for the laser weld beam.

Figure 8:
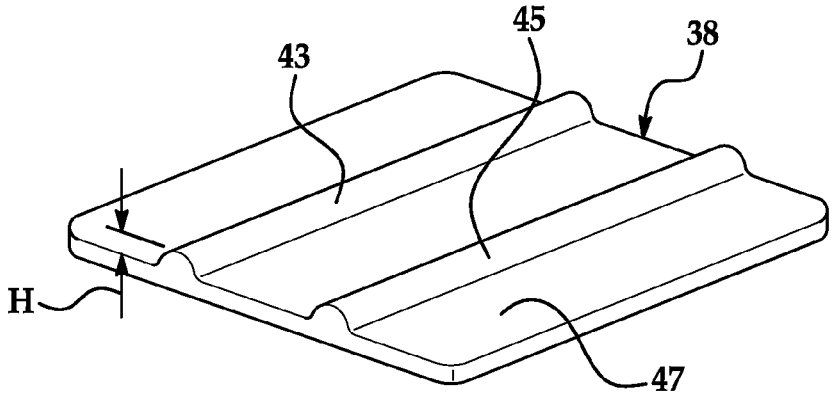
FIG. 8 is a perspective view of an embodiment of a firing pad with a pair of rails.

In another example attachment method, resistance welding is performed as a preliminary tack weld before laser welding, or as the sole and primary weld for attachment without laser welding. In either instance, and now referring to FIG. 8, a first and second protrusion in the form of rails 43, 45 can project from a bottom surface 47 of the firing pad 38. The bottom surface 47 confronts the working surface 28 of the GE body 18 in assembly. During the resistance welding process, electrical current flow is concentrated through the rails 43, 45, and hence increased heat is generated at the rails. In this way, resistance welding is facilitated at the rails 43, 45 and a stronger weld can be formed between the firing pad 38 and the GE body 18 compared to a resistance weld without protrusions. This may also inhibit or altogether preclude separation between the firing pad 38 and the GE body 18, as the increased welding temperature at the rails 43, 45 may allow the firing pad to settle flushly against the working surface 28. In FIG. 8, the rails 43, 45 are rounded, geometrically linear, and span completely across the bottom surface 47, but this is merely one example. In other examples, protrusions could be v-shaped, the rails could be truncated compared to FIG. 8, there could be more or less than two protrusions, and/or the protrusions could simply be knob-like protuberances. Whatever their form, the protrusion has a height H that can differ from embodiment to embodiment. In specific examples, the height H could range between approximately one-half of a thousandth of an inch (0.0005 inches, or 0.0127 mm) to two thousandths of an inch (0.002 inches, or 0.0508 mm), or the height H could be one-half the thickness dimension T of the firing pad 38. Of course, in other embodiments the height H can have other values. Furthermore, the firing pad 38 may be cleaned to remove oil, dirt, and other contaminants from the pad's exterior surfaces before welding; this too may facilitate welding and the formation of a stronger weld.

Figure 9:
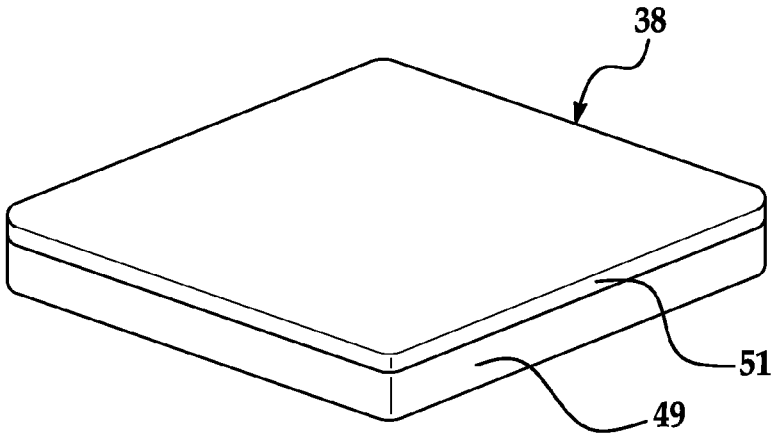
FIG. 9 is a perspective view of an embodiment of a firing pad with multi-layers.

In any of the embodiments presented in this description, the firing pad 38 could be provided in the form of a multi-layer firing pad as shown in FIG. 9. Whether a multi-layer construction is employed in a particular embodiment may depend upon, among other factors, the exact materials selected for the firing pad and the underlying electrode body and their compatibility in terms of welding and thermal transfer properties. The example of FIG. 9 includes a base metal layer 49 and a precious metal layer 51. The base metal layer 49 acts as a backing to provide strength and rigidity to the thinner precious metal layer 51, and is preferably made of a material that enhances initial weldability and subsequent retention to the GE body 18. In other words, in some cases the precious metal material may be more easily attached and retained to the material of the base metal layer 49 than directly to the GE body 18 (such as in the case when manufacturing thin, multi-layered ribbons). Examples of materials for the base metal layer 49 include Ni-alloys that can contain Cr, Fe, aluminum (Al), Mn, Si, and/or another element; and more specific examples include Inconel® 600 or 601. The precious metal layer 51, on the other hand, exchanges sparks across the spark gap G as previously described and can be made of the pure precious metals or the precious metal alloys presented above for the firing pad 38. Again, the multi-layer firing pad of FIG. 9 can be employed in any of the embodiments of FIGS. 3-7 in place of the single-material firing pads, as well as any of the embodiments detailed in this description.

During manufacturing of the spark plug 10, the GE body 18 and the firing pad 38 can be prepared and assembled together in different ways. In one example, and referring to FIG. 10, at a step 100 the GE body 18 is attached to the metallic shell 16 at the attachment interface 24 via a resistance welding process. The schematic in the figure shows the GE body 18 in an unfinished state and before it is bent to its final L-shape. At a step 200, the firing pad 38 is preliminarily attached to the free end portion 46 of the GE body 18 via a tack or resistance weld—in this example, the firing pad has a diamond orientation. At this step, the distances $D_1$, $D_2$, and $D_3$ between the firing pad's side surfaces and the GE body's free end surfaces may or may not satisfy the values and relationships previously described. At a step 300, the free end portion 46 is trimmed via a cutting or severing process. The trimming in this example is similar to that described in connection with FIG. 4. And here, the distances $D_1$, $D_2$, and $D_3$ satisfy the values and relationships described above so that the firing pad 38 and GE body 18 provide enhanced ignitability and flame kernel growth and better thermal management. Lastly in FIG. 10, at a step 400 the firing pad 38 is more permanently attached to the free end portion 46 via a laser weld that produces the weldment 44. After the step 400 a bending and gapping process can be performed to bring the GE body 18 to its finished L-shape.

Figure 10:
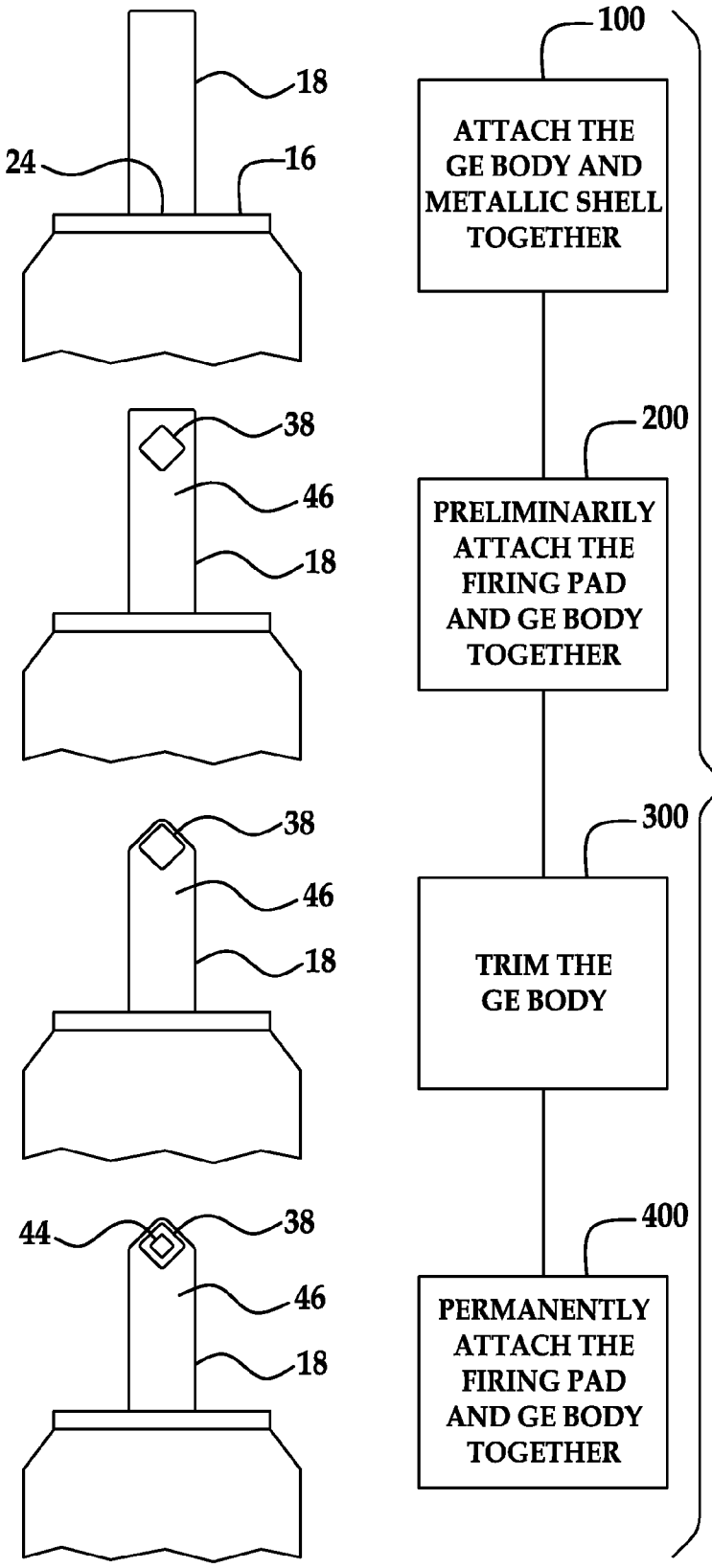
FIG. 10 is a schematic of an exemplary method of preparing a ground electrode and firing pad assembly.

Other preparation and assembly processes can have more, less, and/or different steps than those described with FIG. 10. For example, a laser welding process could be performed prior to the trimming step and—as described earlier in connection with FIG. 5—the cut or sever could then go through the unattached portion 66. In another example, there need not be a preliminary attachment and instead just the more permanent laser weld before or after trimming, or the preliminary attachment could be provided in another way such as by mechanical clamping. In yet another example, the trimming step need not be performed and the firing pad 38 need not have a diamond orientation—this could produce the embodiment of FIG. 3. And in another example, the laser welding could be omitted and instead a resistance weld could provide the permanent attachment of step 400.

Thermal testing was conducted in order to observe retention performance between the firing pad 38 and an electrode body. In the testing, the firing pad 38 and electrode body were attached to each other with laser welding similar to the embodiment of FIG. 3, with a firing pad of Pt30Ni. In general, the thermal testing subjected the firing pad 38, electrode body, and weldment 44 to an increased temperature for a relatively brief period of time, and then allowed them to cool to ambient temperature. The testing was meant to mimic expansion and contraction thermal stresses that are more extreme than those experienced in application in a typical internal combustion engine. In the example testing conducted, a sample spark plug was mounted in a collar-like structure made of brass material. The collar structure was secured to the shell of the sample spark plug and did not make direct abutment with the electrode body; the mount structure acted as a heat sink and facilitated cooling. An induction heater was then used to heat the attached firing pad 38 and electrode body up to approximately 1,700° F. for about twenty seconds. After that, the firing pad 38 and electrode body were allowed to cool at rest down to about room temperature or slightly above room temperature. This rise and fall in temperature constituted a single test cycle, and the thermal testing was conducted on numerous sample spark plugs. On average, the sample spark plugs were capable of enduring over one-hundred-and-seventy-five cycles without exhibiting significant cracking, separation, or other conditions that could negatively impact retention between the firing pad 38 and the electrode body. One-hundred-and-seventy-five cycles is considerably greater than the one-hundred-and-twenty-five cycles oftentimes deemed acceptable for such products, and was unexpected in view of how thin the firing pads were. The cycles endured in the testing here is also comparable to pads with much greater thicknesses than the thin firing pads tested—this too was unexpected. It should be appreciated that not all testing will yield these exact results, as different testing parameters, samples, equipment, as well as other factors, can alter the outcome of testing performance.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A spark plug, comprising:

a shell having an axial bore;

an insulator having an axial bore and being disposed at least partially within the axial bore of the shell;

a center electrode disposed at least partially within the axial bore of the insulator;

a ground electrode attached to the shell and having a free end surface; and a firing pad made of a precious metal material attached to the ground electrode with a weldment, the firing pad having a side surface at a peripheral edge (P) of the firing pad, wherein the free end surface of the ground electrode and the side surface of the firing pad are flush or nearly flush relative to each other, and the weldment is located inboard of the side surface of the firing pad along at least part of an extent where the free end surface of the ground electrode and the side surface of the firing pad are flush or nearly flush relative to each other.

2. A spark plug as defined in claim 1, wherein the firing pad is a thin pad that has a greatest width dimension across its sparking surface that is at least several times larger than a greatest thickness dimension (T).

3. A spark plug as defined in claim 1, wherein a shortest distance between the free end surface of the ground electrode and the side surface of the firing pad is less than or equal to approximately 0.7 mm.

4. A spark plug as defined in claim 1, wherein the free end surface of the ground electrode and the side surface of the firing pad are flush relative to each other for at least some portion of the peripheral edge (P) of the firing pad.

5. A spark plug as defined in claim 1, wherein the free end surface of the ground electrode includes a first free end surface and a second free end surface that intersect at a free end corner, the side surface of the firing pad includes a first side surface and a second side surface that intersect at a corner, and the first free end surface and first side surface are flush or nearly flush relative to each other, the second free end surface and second side surface are flush or nearly flush relative to each other, and the free end corner and corner are flush or nearly flush relative to each other.

6. A spark plug as defined in claim 1, wherein the free end surface of the ground electrode is a trimmed free end surface produced via a trimming process, the side surface of the firing pad is a trimmed side surface produced via the same trimming process, and the trimmed side surface is situated at least in part at a weldment attaching the firing pad and ground electrode together.

7. A spark plug as defined in claim 1, wherein, before attachment to the ground electrode, the firing pad has at least one protrusion projecting from a bottom surface of the firing pad, the at least one protrusion concentrating current flow therethrough during a resistance welding process.

8. A spark plug as defined in claim 1, wherein the firing pad is a multi-layer firing pad with a base metal layer and a precious metal layer, the base metal layer composed of a nickel alloy material and attached to the ground electrode.

9. A spark plug as defined in claim 1, wherein a shortest distance between the free end surface of the ground electrode and the side surface of the firing pad ranges between approximately 0% to 500%, inclusive, of a thickness dimension (T) of the firing pad.

10. A spark plug, comprising:

a shell having an axial bore;

an insulator having an axial bore and being disposed at least partially within the axial bore of the shell;

a center electrode disposed at least partially within the axial bore of the insulator;

a ground electrode attached to the shell and having a free end surface; and a firing pad made of a precious metal material attached to the ground electrode, the firing pad having a side surface at a peripheral edge (P) of the firing pad, wherein the free end surface of the ground electrode and the side surface of the firing pad are flush or nearly flush relative to each other, and the firing pad is attached to the ground electrode via a keyhole weldment that is located at least in part inboard of the peripheral edge (P) of the firing pad, the keyhole weldment penetrating entirely through a thickness (T) of the firing pad and through a surface-to-surface interface between the ground electrode and firing pad where the keyhole weldment is inboard of the peripheral edge (P).

11. A spark plug, comprising:

a shell having an axial bore;

an insulator having an axial bore and being disposed at least partially within the axial bore of the shell;

a center electrode disposed at least partially within the axial bore of the insulator;

a ground electrode attached to the shell and having a free end surface; and a firing pad made of a precious metal material attached to the ground electrode, the firing pad having a side surface at a peripheral edge (P) of the firing pad, wherein the free end surface of the ground electrode and the side surface of the firing pad are flush or nearly flush relative to each other, and a shortest distance between the free end surface of the ground electrode and the side surface of the firing pad is less than a shortest distance between the free end surface of the ground electrode and a weldment of the attached firing pad and ground electrode.

12. A spark plug, comprising:

a shell having an axial bore;

an insulator having an axial bore and being disposed at least partially within the axial bore of the shell;

a center electrode disposed at least partially within the axial bore of the insulator;

a ground electrode attached to the shell and having a free end surface; and a firing pad made of a precious metal material attached to the ground electrode, the firing pad having a side surface at a peripheral edge (P) of the firing pad, wherein the free end surface of the ground electrode and the side surface of the firing pad are flush or nearly flush relative to each other, and the free end surface of the ground electrode is a trimmed free end surface produced via a trimming process, the side surface of the firing pad is a trimmed side surface produced via the same trimming process, and the trimmed side surface is situated at an unattached portion of the firing pad and is not situated at a weldment attaching the firing pad and ground electrode together.

13. A method of preparing a ground electrode and firing pad assembly, the method comprising the steps of:

trimming a free end portion of the ground electrode, leaving a trimmed free end surface;

locating the firing pad at the free end portion, the firing pad having a side surface located at or near the trimmed free end surface of the ground electrode; and emitting a laser beam to the firing pad and inboard of the side surface at an extent of the side surface that is located at or near the trimmed free end surface.

14. A method as defined in claim 13, wherein the step of locating the firing pad comprises resistance welding the firing pad at the free end portion.

15. A method of preparing a ground electrode and firing pad assembly, the method comprising the steps of:

laser welding the firing pad to a free end portion of the ground electrode, the laser welding producing a weldment, the firing pad having a side surface; and trimming the free end portion of the ground electrode along a trim line situated at or near the side surface of the firing pad, wherein the weldment is positioned inboard of the side surface at least where the trim line is situated at or near the side surface.

16. A method as defined in claim 15, wherein the trim line is situated inboard of the side surface of the firing pad and outboard of the weldment such that the trimming is carried out through an unattached portion of the firing pad.

17. A method as defined in claim 15, wherein the trim line is situated at least in part through the weldment such that the trimming is carried out through the weldment.

* * * * *